US009237404B2

(12) United States Patent
Ozden et al.

(10) Patent No.: US 9,237,404 B2
(45) Date of Patent: Jan. 12, 2016

(54) DIPOLE ANTENNA FOR A HEARING AID

(71) Applicant: GN ReSound A/S, Ballerup (DK)

(72) Inventors: Sinasi Ozden, Rodovre (DK); Birol Akdeniz, Brondby Strand (DK)

(73) Assignee: GN RESOUND A/S, Ballerup (DK)

( * ) Notice: Subject to any disclaimer, the term of this patent is extended or adjusted under 35 U.S.C. 154(b) by 0 days.

(21) Appl. No.: 13/848,605

(22) Filed: Mar. 21, 2013

(65) Prior Publication Data

US 2014/0185848 A1 Jul. 3, 2014

(30) Foreign Application Priority Data

Dec. 28, 2012 (EP) ..... 12199674

(51) Int. Cl.
*H04R 25/00* (2006.01)

(52) U.S. Cl.
CPC ..... *H04R 25/554* (2013.01); *H04R 25/55* (2013.01); *H04R 25/558* (2013.01); *H04R 2225/51* (2013.01); *H04R 2225/63* (2013.01)

(58) Field of Classification Search
CPC ..... H04R 25/60; H04R 25/65; H04R 25/554; H04R 25/606; H04R 25/558; H04R 2420/07; H04R 2225/51; H04R 2225/63; H04R 2225/021; H04R 1/105; H04R 25/55; H04R 25/552
USPC ..... 381/312, 315, 322, 324, 328, 330, 381, 381/382, 384
See application file for complete search history.

(56) References Cited

U.S. PATENT DOCUMENTS

| | | | |
|---|---|---|---|
| 2,535,063 | A | 12/1950 | Halstead |
| 3,276,028 | A | 9/1966 | Mayes et al. |
| 4,334,315 | A | 6/1982 | Ono et al. |
| 4,924,237 | A | 5/1990 | Honda et al. |

(Continued)

FOREIGN PATENT DOCUMENTS

| | | | |
|---|---|---|---|
| CN | 1684549 | A | 10/2005 |
| CN | 101835082 | A | 9/2010 |

(Continued)

OTHER PUBLICATIONS

First Technical Examination and Search Report dated Aug. 9, 2013 for related Danish Patent Application No. PA 2012 70831, 3 pages.

(Continued)

*Primary Examiner* — Huyen D Le
(74) *Attorney, Agent, or Firm* — Vista IP Law Group, LLP

(57) ABSTRACT

A hearing aid includes: a hearing aid housing; a microphone coupled to the hearing aid housing for reception of sound and conversion of the received sound into a corresponding first audio signal; a signal processor in the hearing aid housing for processing the first audio signal into a second audio signal compensating a hearing loss of a user of the hearing aid; a wireless communication unit connected to the signal processor for wireless data communication; and an attachment member connectable to the hearing aid housing; wherein the wireless communication unit is coupled with an antenna having a first pole element and a second pole element for emission and reception of an electromagnetic field; and wherein at least a part of the first pole element extends in the attachment member, and the second pole element extends in the hearing aid housing.

26 Claims, 11 Drawing Sheets

(56) References Cited

U.S. PATENT DOCUMENTS

| | | | | |
|---|---|---|---|---|
| 5,621,422 | A | 4/1997 | Wang | |
| 5,721,783 | A | 2/1998 | Anderson | |
| 5,760,746 | A | 6/1998 | Kawahata | |
| 5,761,319 | A | 6/1998 | Dar et al. | |
| 6,515,629 | B1 | 2/2003 | Kuo | |
| 6,748,094 | B1 | 6/2004 | Tziviskos et al. | |
| 7,002,521 | B2 | 2/2006 | Egawa et al. | |
| 7,154,442 | B2 | 12/2006 | Van Wonterghem et al. | |
| 7,256,747 | B2 | 8/2007 | Victorian et al. | |
| 7,446,708 | B1 | 11/2008 | Nguyen et al. | |
| 7,570,777 | B1 | 8/2009 | Taenzer et al. | |
| 7,593,538 | B2 | 9/2009 | Polinske | |
| 7,652,628 | B2 | 1/2010 | Zweers | |
| 7,791,551 | B2 | 9/2010 | Platz | |
| 7,978,141 | B2 | 7/2011 | Chi et al. | |
| 8,300,863 | B2 | 10/2012 | Knudsen et al. | |
| 8,494,197 | B2 | 7/2013 | Polinske et al. | |
| 2004/0080457 | A1 | 4/2004 | Guo | |
| 2004/0246179 | A1 | 12/2004 | Chen et al. | |
| 2005/0068234 | A1 | 3/2005 | Hung et al. | |
| 2005/0094840 | A1 | 5/2005 | Harano | |
| 2005/0099341 | A1 | 5/2005 | Zhang et al. | |
| 2005/0244024 | A1 | 11/2005 | Fischer et al. | |
| 2005/0248717 | A1 | 11/2005 | Howell et al. | |
| 2006/0012524 | A1 | 1/2006 | Mierke et al. | |
| 2006/0018496 | A1 | 1/2006 | Niederdrank et al. | |
| 2006/0061512 | A1 | 3/2006 | Asano et al. | |
| 2006/0071869 | A1 | 4/2006 | Yoshino et al. | |
| 2006/0115103 | A1 | 6/2006 | Feng et al. | |
| 2006/0181466 | A1 | 8/2006 | Krupa | |
| 2006/0192723 | A1 | 8/2006 | Harada et al. | |
| 2007/0080889 | A1 | 4/2007 | Zhang | |
| 2007/0171134 | A1 | 7/2007 | Yoshino et al. | |
| 2007/0229369 | A1 | 10/2007 | Platz | |
| 2007/0229376 | A1 | 10/2007 | Desclos et al. | |
| 2007/0230714 | A1 | 10/2007 | Armstrong | |
| 2007/0285321 | A1 | 12/2007 | Chung | |
| 2008/0024375 | A1 | 1/2008 | Martin et al. | |
| 2008/0056520 | A1 | 3/2008 | Christensen et al. | |
| 2008/0079645 | A1 | 4/2008 | Higasa et al. | |
| 2008/0231524 | A1 | 9/2008 | Zeiger et al. | |
| 2009/0074221 | A1 | 3/2009 | Westermann | |
| 2009/0124201 | A1 | 5/2009 | Meskens | |
| 2009/0196444 | A1* | 8/2009 | Solum | 381/315 |
| 2009/0231204 | A1 | 9/2009 | Shaker et al. | |
| 2009/0231211 | A1 | 9/2009 | Zweers | |
| 2009/0243944 | A1 | 10/2009 | Jung et al. | |
| 2009/0273530 | A1 | 11/2009 | Chi et al. | |
| 2009/0315787 | A1 | 12/2009 | Schatzle | |
| 2010/0020994 | A1 | 1/2010 | Christensen et al. | |
| 2010/0033380 | A1 | 2/2010 | Pascolini et al. | |
| 2010/0158291 | A1 | 6/2010 | Polinske et al. | |
| 2010/0158293 | A1 | 6/2010 | Polinske et al. | |
| 2010/0158295 | A1 | 6/2010 | Polinske et al. | |
| 2010/0172525 | A1 | 7/2010 | Angst et al. | |
| 2010/0245201 | A1 | 9/2010 | Hossain et al. | |
| 2010/0321269 | A1 | 12/2010 | Ishibana et al. | |
| 2011/0007927 | A1* | 1/2011 | Hedrick et al. | 381/376 |
| 2011/0022121 | A1 | 1/2011 | Meskins | |
| 2011/0129094 | A1 | 6/2011 | Petersen | |
| 2011/0294537 | A1 | 12/2011 | Vance | |
| 2012/0087506 | A1 | 4/2012 | Ozden | |
| 2012/0093324 | A1 | 4/2012 | Sinasi | |
| 2012/0154222 | A1 | 6/2012 | Oh et al. | |
| 2013/0308805 | A1 | 11/2013 | Ozden Sinasi | |
| 2014/0010392 | A1 | 1/2014 | Kvist | |
| 2014/0321685 | A1 | 10/2014 | Rabel | |

FOREIGN PATENT DOCUMENTS

| | | | |
|---|---|---|---|
| DE | 3625891 | A1 | 2/1988 |
| DE | 10 2004 01783 | | 10/2005 |
| DE | 10 2008 022 127 | A1 | 11/2009 |
| EP | 1 231 819 | A2 | 8/2002 |
| EP | 1294049 | A1 | 3/2003 |
| EP | 1 465 457 | A2 | 10/2004 |
| EP | 1 465 457 | A3 | 10/2004 |
| EP | 1 589 609 | A2 | 10/2005 |
| EP | 1 594 188 | A1 | 11/2005 |
| EP | 1 681 903 | A2 | 7/2006 |
| EP | 1 763 145 | A1 | 3/2007 |
| EP | 1 953 934 | A1 | 8/2008 |
| EP | 2 088 804 | A1 | 8/2009 |
| EP | 2 200 120 | A2 | 6/2010 |
| EP | 2 200 120 | A3 | 6/2010 |
| EP | 2 207 238 | A1 | 7/2010 |
| EP | 2 229 009 | A1 | 9/2010 |
| EP | 2 302 737 | | 3/2011 |
| EP | 2 680 366 | | 1/2014 |
| EP | 2 723 101 | A2 | 4/2014 |
| EP | 2 723 101 | A3 | 4/2014 |
| EP | 2 765 650 | | 8/2014 |
| JP | 2005-304038 | A | 10/2005 |
| JP | 2006025392 | | 1/2006 |
| JP | 2006-033853 | A | 2/2006 |
| WO | WO 98/44762 | | 10/1998 |
| WO | WO 2011099226 | A1 | 12/2001 |
| WO | WO 03/026342 | | 3/2003 |
| WO | WO 2004/110099 | A2 | 12/2004 |
| WO | WO 2005/081583 | A1 | 9/2005 |
| WO | WO 2006/055884 | A2 | 5/2006 |
| WO | WO 2006122836 | A2 | 11/2006 |
| WO | 2007072381 | A2 | 6/2007 |
| WO | WO 2007/140403 | A2 | 6/2007 |
| WO | 2008012355 | A1 | 1/2008 |
| WO | WO 2009/010724 | A1 | 1/2009 |
| WO | WO 2009/098858 | A1 | 8/2009 |
| WO | 2009117778 | A1 | 10/2009 |
| WO | WO 2009/117778 | A1 | 10/2009 |
| WO | WO 2010/065356 | A1 | 6/2010 |
| WO | WO 2011099226 | | 8/2011 |
| WO | WO 2012059302 | A2 | 5/2012 |
| WO | WO 2014/090420 | A1 | 6/2014 |

OTHER PUBLICATIONS

Extended European Search Report dated May 7, 2013 for EP Patent Application No. 12199674.8.

Final Office Action dated May 19, 2014 for U.S. Appl. No. 13/740,471.

Non-Final Office Action dated May 22, 2014 for U.S. Appl. No. 13/271,170.

Extended European Search Report dated Mar. 7, 2014 for EP Patent Application No. 11184503.8.

Extended European Search Report dated May 6, 2014 for EP Patent Application No. 13175258.6.

Extended European Search Report dated Apr. 17, 2014 for EP Patent Application No. 13192316.1.

Extended European Search Report dated Apr. 22, 2014 for EP Patent Application No. 13192323.7.

Final Office Action dated Feb. 27, 2014, for U.S. Appl. No. 13/271,180.

Extended European Search Report dated Mar. 7, 2014 for EP Patent Application No. 11184507.9.

Second Danish Office Action dated Apr. 24, 2012 for Danish Patent Application No. PA 2010 00931.

First Danish Office Action dated Apr. 26, 2011 for Danish Patent Application No. PA 2010 00931.

Danish Office Action dated Apr. 30, 2012 for Danish Patent Application No. PA 2011 70566.

Danish Office Action dated May 1, 2012 for Danish Patent Application No. PA 2011 70567.

English Abstract of Foreign Reference DE 10 2008 022 127 A1 (included in 1st page of Foreign Ref.

Third Danish Office Action dated Oct. 17, 2012 for Danish Patent Application No. PA 2010 00931.

First Office Action dated Feb. 12, 2013 for Japanese Patent Application No. 2011-224711.

Fourth Danish Office Action , Intention to Grant dated Feb. 13, 2013 for Danish Patent Application No. PA 2010 00931.

(56) References Cited

OTHER PUBLICATIONS

Notice of Reasons for Rejection dated May 21, 2013 for Japanese Patent Application No. 2011-224705.
Non-final Office Action dated Oct. 8, 2013 for U.S. Appl. No. 13/271,180.
Chinese Office Action and Search Report dated Nov. 12, 2013 for related CN Patent Application No. 201110317264.6.
Chinese Office Action and Search Report dated Dec. 4, 2013 for related CN Patent Application No. 201110317229.4.
1st Technical Examination and Search Report dated Jan. 25, 2013 for DK Patent Application No. PA 2012 70412, 4 pages.
1st Technical Examination and Search Report dated Jan. 24, 2013 for DK Patent Application No. PA 2012 70411, 5 pages.
Second Technical Examination dated Aug. 6, 2013 for DK Patent Application No. PA 2012 70411, 2 pages.
Second Technical Examination—Intention to Grant dated Jul. 8, 2013 for DK Patent Application No. PA 2012 70412, 2 pages.
Non-final Office Action dated Jan. 2, 2014 for U.S. Appl. No. 13/740,471.
First Technical Examination and Search Report Dated Jan. 18, 2013 for DK Patent Application No. PA 2012 70410, 4 pages.
Second Technical Examination dated Jul. 12, 2013, for DK Patent Application No. PA 2012 70410, 2 pages.
Third Technical Examination dated Jan. 31, 2014, for DK Patent Application No. PA 2012 70410, 2 pages.
Advisory Action dated Aug. 29, 2014 for U.S. Appl. No. 13/740,471.
Non-Final Office Action dated Jul. 29, 2014 for U.S. Appl. No. 13/917,448.
Office Action dated Jun. 17, 2014 in Japanese Patent Application No. 2013-258396, 3 pages.
First Technical Examination dated Jun. 25, 2014 for DK Patent Application No. PA 2013 70665, 5 pages.
First Technical Examination dated Jun. 26, 2014 for DK Patent Application No. PA 2013 70664, 5 pages.
Extended European Search Report dated May 14, 2014 for EP Patent Application No. 13192322.9.
First Technical Examination and Search Report dated Jun. 26, 2014 for DK Patent Application No. PA 2013 70667, 5 pages.
First Technical Examination and Search Report dated Jun. 27, 2014 for DK Patent Application No. PA 2013 70666.
Non-final Office Action dated Nov. 18, 2014 for U.S. Appl. No. 13/271,180.
Conway et al., Antennas for Over-Body-Surface Communication at 2.45 GHz, Apr. 2009, IEEE Transactions on Antennas and Propagation, vol. 57, No. 4, pp. 844-855.
Non-final Office Action dated Nov. 19, 2014 for U.S. Appl. No. 13/931,556.
Non-final Office Action dated Feb. 24, 2015 for U.S. Appl. No. 14/202,486.
Notice of Allowance dated Mar. 5, 2015 for U.S. Appl. No. 13/917,448.
Notice of Allowance dated Apr. 24, 2015 for U.S. Appl. No. 13/931,556.
First Technical Examination and Search Report dated Mar. 9, 2015, for related Danish Patent Application No. PA 2014 70489.
Non-final Office Action dated Dec. 18, 2014 for U.S. Appl. No. 13/740,471.
Final Office Action dated Dec. 31, 2014 for U.S. Appl. No. 13/271,170.
Extended European Search Report dated Oct. 9, 2014 for EP Patent Application No. 14181165.3.
"Novelty Search including a Preliminary Patentability Opinion Report", dated Jul. 28, 2011 (8 pages).
Non-final Office Action dated Jan. 15, 2015 for U.S. Appl. No. 14/199,511.
Non-final Office Action dated Feb. 5, 2015 for U.S. Appl. No. 14/198,396.
Non-final Office Action dated May 7, 2015 for U.S. Appl. No. 13/271,180.
Advisory Action dated May 14, 2015 for U.S. Appl. No. 13/271,170.
Non-final Office Action dated Jun. 10, 2015 for U.S. Appl. No. 14/199,263.
Notice of Allowance and Fee(s) Due dated Jun. 18, 2015, for U.S. Appl. No. 13/917,448.
Communication pursuant to Article 94(3) EPC dated Mar. 16, 2015, for related European Patent Application No. 11 184 503.8, 12 pages.
Communication pursuant to Article 94(3) EPC dated Mar. 19, 2015, for related European Patent Application No. 11 184 507.9, 12 pages.
Non-final Office Action dated Jul. 1, 2015 for U.S. Appl. No. 14/199,070.
Final Office Action dated Jul. 15, 2015 for U.S. Appl. No. 13/740,471.
Notice of Allowance and Fees Due dated Aug. 3, 2015 for related U.S. Appl. No. 13/931,556.
Non-final Office Action dated Aug. 17, 2015 for related U.S. Appl. No. 14/198,396.
Non-final Office Action dated Aug. 25, 2015 for related U.S. Appl. No. 14/202,486.
Notice of Allowance and Fee(s) Due dated Sep. 2, 2015 for related U.S. Appl. No. 14/199,511.
Notice of Allowance and Fee(s) Due dated Sep. 25, 2015 for related U.S. Appl. No. 13/271,170.

* cited by examiner

DIPOLE ANTENNA FOR A HEARING AID

RELATED APPLICATION DATA

This application claims priority to and the benefit of Danish Patent Application No. PA 2012 70831, filed on Dec. 28, 2012, pending, and European Patent Application No. 12199674.8, filed on Dec. 28, 2012, pending. The disclosures of both of the above applications are expressly incorporated by reference in their entireties herein.

FIELD

The application relates to antennas for hearing aids, and especially for antennas extending in hearing aid housing attachment members or outside of a hearing aid housings, and particularly to antennas, such as dipole antennas, having a first pole element extending in an attachment member and a second pole element extending in the hearing aid housing.

BACKGROUND

Hearing aids are very small and delicate devices and comprise many electronic and metallic components contained in a housing small enough to fit in the ear canal of a human or behind the outer ear. The many electronic and metallic components in combination with the small size of the hearing aid housing impose high design constraints on radio frequency antennas to be used in hearing aids with wireless communication capabilities.

Conventionally, antennas in hearing aids have been used for receiving radio broadcasts or commands from a remote control. Typically, such antennas are designed to fit in the hearing aid housing without special concern with relation to the efficiency of the antenna.

A variety of hearing aids are known, including so called behind-the-ear hearing aids, in-the-ear hearing aids, receiver-in-the-ear hearing aids, etc. Some hearing aids have been designed with a cable or a sound tube connecting hearing aid elements positioned behind the ear of a user with hearing aid elements position in the ear of a user. It has been suggested to use such cables or sound tubes for accommodating antenna elements. For example in U.S. Pat. No. 8,300,863, a hearing aid having a cable or a sound tube connecting the hearing aid to a receiver in the ear of a user or to a speaker in the ear, respectively, is configured for wireless communication via an antenna, and the cable or sound tube comprises a conducting element forming at least part of the antenna. Furthermore, EP 2 088 804 discloses a hearing aid having a cable comprising one or more conductors for connecting a hearing aid housing with a transducer in the ear of a user. To enable wireless communication, a wireless transceiver in the hearing aid may be connected to one of the transducer cables to provide a monopole antenna, or the wireless transceiver may be connected to two transducer cables to provide a dipole antenna for the wireless transceiver.

SUMMARY

It is an object to provide an improved antenna design for hearing aids.

According to a first aspect of some embodiments described herein, the above and other objects are fulfilled by a hearing aid comprising a hearing aid housing having a microphone for reception of sound and conversion of the received sound into a corresponding first audio signal, a signal processor for processing the first audio signal into a second audio signal compensating a hearing loss of a user of the hearing aid, and a wireless communications unit connected to the signal processor for wireless data communication, the wireless communications unit is interconnected with an antenna having a first pole element and a second pole element for emission and reception of an electromagnetic field. The hearing aid further comprises an attachment member connectable to the hearing aid housing and at least a part of the first pole element extends via the attachment member, and a second pole element of the dipole antenna extends in the hearing aid housing.

According to a second aspect of some embodiments described herein, the above and other objects are fulfilled by a hearing aid comprising a hearing aid housing having a microphone for reception of sound and conversion of the received sound into a corresponding first audio signal, a signal processor for processing the first audio signal into a second audio signal compensating a hearing loss of a user of the hearing aid, and a wireless communications unit connected to the signal processor for wireless data communication, the wireless communications unit is interconnected with an antenna having a first pole element and a second pole element for emission and reception of an electromagnetic field wherein at least a part of the first pole element extends outside of the hearing aid housing, and the second pole element of the antenna extends within the hearing aid housing.

According to a third aspect of some embodiments described herein, the above and other objects are fulfilled by a hearing instrument comprising a hearing instrument housing for reception of a sound signal and a speaker for providing the sound signal to the ear of a user, a wireless communications unit for wireless data communication, the wireless communications unit is interconnected with an antenna having a first pole element and a second pole element for emission and reception of an electromagnetic field. The hearing instrument further comprises an attachment member connectable to the hearing instrument housing and at least a part of the first pole element extends via the attachment member, and a second pole element of the dipole antenna extends in the hearing instrument housing.

According to a fourth aspect of some embodiments described herein, a set of attachment members is provided. The set of attachment members comprises a first attachment member configured to interconnect with a hearing aid housing, and a second attachment member configured to interconnect with a hearing aid housing, the first attachment member having a first length and the second attachment member having a second length, the first attachment member comprising a first antenna element and the second attachment member comprising a second antenna element, wherein the first antenna element has a first antenna length and the second antenna element has a second antenna length and wherein the absolute relative difference of the first antenna length and the second antenna length is less than a first threshold, such as 10%. Thus, it is envisaged that the first antenna length is equal to, or substantially equal to, the second antenna length. In one or more embodiments, the first length of the first attachment member is different from the second length of the second attachment member. Thereby, the field distribution of the antenna is substantially the same irrespective of the length of the attachment member. It is an advantage that a renewed matching of the antenna is not required when an attachment member is exchanged.

It is an advantage that the antenna is not connected to a ground plane in the hearing aid housing. Hereby, the radiation pattern of the antenna may be independent of e.g. circuit board radiation, and thereby the radiation pattern for the antenna may be more tightly controlled. It is a further advantage that the first pole element and the second pole element may be separated so that coupling between the first pole element and the second pole element is minimized.

The attachment member may be any attachment member configured to be attached to the hearing aid housing. The attachment member may be a holding member for holding the hearing aid in place during use, the attachment member may be configured to transmit the second audio signal from the hearing aid housing to the ear of a user, etc.

The length of the attachment member may be determined by the size of a user's ear to allow for a smooth fitting, and may for example be selected during fitting of the hearing aid. The length of an attachment member varies depending on the type of attachment member provided. For some attachment members, e.g. for attachment members for sound transmission, the length of the attachment members may typically range from about 50 mm to about 70 mm, and the attachment members are typically available in a number of predetermined lengths. As the attachment members are exposed to the environment, including the user's head, the material may degrade over time, and typically need to be exchanged at regular intervals.

The length of the antenna, such as the length of first pole element, may be a fixed or same length, such that the length of the antenna, such as the length of the first pole element, is the same for all attachment member lengths.

The first pole element and the second pole element may have a same length, such as a length of half a wavelength of an operating frequency for the antenna, such as a length corresponding to the length of the attachment member, such as a length corresponding to a smallest length of the attachment member.

Thus, by providing a fixed length of the antenna, such as of the first pole element, for all attachment member lengths, a properly matched antenna is ensured irrespective of attachment member changes. It is a further advantage of providing a fixed length of the first pole element irrespective of the length of the attachment member that the second pole element positioned in the hearing aid housing has a fixed length so that the frequency response of the antenna is not varied if an attachment member is exchanged.

Alternatively, the length of first pole element may extend over the length of the attachment member.

The required physical length of the antenna, whether the length is the same or is varied with attachment member length, may be decreased by interconnecting the antenna with an electronic component, a so-called antenna shortening component, having an impedance that modifies the standing wave pattern of the antenna thereby changing its effective length. The required physical length of the antenna may for example be shortened by connecting the antenna in series with an inductor or in shunt with a capacitor to obtain a desired length of the antenna, to e.g. obtain a desired frequency response for the antenna.

In some embodiments, the attachment member may be a sound transmission member for transmission of sound from the hearing aid housing to the ear of a user. The second sound signal may be transmitted electrically or acoustically to the ear of a user.

The attachment member may comprise a sound tube and in some embodiments, the second audio signal may be coupled to the ear of a user by transforming the second audio signal to an acoustic signal and transmitting the acoustic signal to the ear of a user via the sound tube. The sound tube may be a thin tube, and the acoustic signal may be transmitted via acoustic wave propagation in the thin tube. The second audio signal may be transformed to an acoustic signal via a transducer, such as a speaker. Typically, this configuration is used when a hearing aid housing of a behind-the-ear hearing aid is provided behind the ear of a user and a sound is transmitted from the hearing aid housing to the ear of a user. An ear mould may receive the transmitted signal and provide it to the inner ear of the user. The hearing aid housing of the behind-the-ear hearing aid may thus further comprise a transducer for transforming the second audio signal into a sound to be transmitted by the sound tube to the ear of a user.

The attachment member may comprise one or more conductors for conducting the second audio signal to a receiver positioned in the ear of a user. Typically, the conductors are electrically conducting conductors and the second audio signal is transmitted electrically to the ear of a user via the conductors. Typically, this configuration is used when a hearing aid housing of a receiver-in-the-ear hearing aid is provided behind the ear of a user and the second audio signal is electrically transmitted to a receiver positioned in the ear of a user. Thus, the electrical signal is transmitted to the ear and at this stage. An ear mould may receive the transmitted signal and provide it to the inner ear of the user. The hearing aid housing of the behind-the-ear hearing aid may thus further comprise a transducer for transforming the second audio signal into a sound to be transmitted by the sound tube to the ear of a user.

The antenna has a first pole element and a second pole element for emission and reception of an electromagnetic field, and is fed in between the first and second pole elements. The antenna may be a dipole antenna.

The antenna including the first pole element and the second pole element may be confined within the hearing aid housing and the attachment member, so that no part of the antenna protrudes from the hearing aid housing or the attachment member.

Alternatively, the first pole element, or at least a part of the first pole element, such as substantially the entire first pole element, may extend in free air outside of the hearing aid housing, and outside any attachment member.

The attachment member may comprise a conducting element, particularly an electrically conductive element, and the conducting member may form at least a part of the first pole element. The conducting element may be an additional conducting element provided in the attachment member to form at least a part of the first pole element, for example, the conducting element may be provided specifically or exclusively to form a part of the first pole element.

The conducting element, particularly an electrically conductive element, may form part of a cable assembly configured to connect the hearing aid housing with the ear of a user, such as for example to electrically transmit the second audio signal from the hearing aid housing to the ear of a user, such as to a receiver in the ear of a user. The antenna may reuse the conducting element electrically transmitting the second audio signal from the hearing aid housing to the ear of a user to also act as antenna.

The second pole element may have any shape, and may have the shape of a patch antenna, a rod antenna, a meander line antenna, etc. or any combination thereof.

The second pole element is positioned in the hearing aid housing and may be at least primarily extending within the hearing aid housing. The positioning of the second pole element within the housing may be a determining factor for the radiation pattern for the antenna. In some embodiments, the second pole element may extend along a top surface of the hearing aid housing. It is an advantage of positioning the second pole element along a top surface of the hearing aid that the position of the head with respect to the second pole element is substantially unchanged irrespective of whether the hearing aid is positioned at the right ear of a user or the left ear of a user.

The second pole element may in some embodiments have a first section extending along a first side of the hearing aid housing and a second section extending along a second side of the hearing aid housing. A length of the first section may corresponds substantially to a length of the second section, and the length of the first section and the second section of the second pole element may be substantially the same, i.e. substantially equal. Furthermore, in some embodiments, the first section and the second section may have a substantially same shape, and the first section and the second section may be symmetrical. The first section and the second section may be symmetrical about an axis of the hearing aid housing, such as about a middle plane partitioning the hearing aid housing in two equal parts in a longitudinal direction, i.e. in a direction parallel to the surface of the head when the hearing aid is provided in its intended operational position.

In one or more embodiments, the first pole element may have a first section extending via the attachment member and a second section extending in the hearing aid housing. The second section of the first pole element extending in the hearing aid housing may have a same shape as the second pole element.

The second section of the first pole element may extend along one side of the hearing aid housing while the second pole element may extends along another side of the hearing aid housing.

The wireless communications unit is configured for wireless data communication, and in this respect interconnected with the antenna for emission and reception of an electromagnetic field. The wireless communications unit may comprise a transmitter, a receiver, a transmitter-receiver pair, such as a transceiver, a radio unit, etc. The wireless communications unit may be configured for communication using any protocol as known for a person skilled in the art, including Bluetooth, WLAN standards, manufacture specific protocols, such as tailored proximity antenna protocols, such as proprietary protocols, such as low-power wireless communication protocols, etc.

The wireless communications unit interconnected with the antenna may be configured for operation in the ISM frequency band. The wireless communications unit interconnected with the antenna may be configured for operation at a frequency of at least 100 MHz, such as at a frequency of at least 800 MHz, such as at least 1 GHz, such as at a frequency between 1.5 GHz and 3 GHz, such as at a frequency of 2.4 GHz, such as at substantially 2.4 GHz.

The wireless communications unit may be configured for communication with external devices, such as hearing aid accessories, such as remote controls, telephones, such as mobile telephones, televisions, television boxes, television streamer boxes, spouse microphones, hearing aid fitting systems, etc.

The wireless communications unit may also be configured for communication with another hearing aid in a binaural hearing aid, so that data may be exchanged between the hearing aid positioned at the right ear of a user and the hearing aid positioned at the left ear of the user. Such binaural communication may be used for example for binaural beam forming, for binaural noise reduction, etc.

The hearing aid may further comprise a variable matching circuit for electrically matching the antenna with the wireless communications unit.

The antenna may be a dipole antenna and may be fed in between the first pole element and the second pole element, such as in the center between the first pole element and the second pole element, such as substantially in the center between the first pole element and the second pole element. The dipole antenna may be a balanced dipole antenna. The antenna design may be inherently symmetric, so as to provide a balance antenna without the use of balun components, etc.

The hearing aid housing may comprise hearing aid electronics, such as hearing aid electronics provided on e.g. a printed circuit board. In the prior art, many hearing aid antennas have been using the printed circuit board as a ground plane for a hearing aid antenna, whereby the radiation pattern is dependent also on the (non-controlled) radiation from the printed circuit board.

It is an advantage of the present antenna that the antenna the printed circuit board is not used as a ground plane for the antenna.

A hearing aid includes: a hearing aid housing; a microphone coupled to the hearing aid housing for reception of sound and conversion of the received sound into a corresponding first audio signal; a signal processor in the hearing aid housing for processing the first audio signal into a second audio signal compensating a hearing loss of a user of the hearing aid; a wireless communication unit connected to the signal processor for wireless data communication; and an attachment member connectable to the hearing aid housing; wherein the wireless communication unit is coupled with an antenna having a first pole element and a second pole element for emission and reception of an electromagnetic field; and wherein at least a part of the first pole element extends in the attachment member, and the second pole element extends in the hearing aid housing.

Optionally, the attachment member is configured to transmit the second audio signal from within the hearing aid housing to an ear of the user.

Optionally, the attachment member is configured to hold the hearing aid in its position around an ear of the user.

Optionally, the antenna is confined within the hearing aid housing and the attachment member.

Optionally, the attachment member comprises a conducting element.

Optionally, the conducting element forms at least a part of the first pole element of the antenna.

Optionally, the first pole element and the second pole element of the antenna have a same length.

Optionally, the second pole element of the antenna comprises a patch antenna, a rod antenna, a meander line antenna, or any combination thereof.

Optionally, the second pole element of the antenna extends along a top surface of the hearing aid housing.

Optionally, the second pole element of the antenna has a first section extending along a first side of the hearing aid housing, and a second section extending along a second side of the hearing aid housing.

Optionally, the first section and the second section are substantially symmetrical. For example, a feature (e.g., a length, orientation, etc.) of the first section and a feature of the second section may be the same, or may differ by no more than 10%, in some embodiments.

Optionally, a length of the first section corresponds substantially to a length of the second section. For example, the lengths of the first section and the second section may be the same, or may differ by no more than 10%, in some embodiments.

Optionally, the attachment member comprises a sound tube.

Optionally, the hearing aid also includes a converter for converting the second audio signal into an acoustic signal, wherein the sound tube is configured to transmit the acoustic signal to an ear of the user.

Optionally, the hearing aid also includes a receiver sized for placement in an ear of the user, wherein the attachment member comprises one or more conductors conducting the second audio signal to the receiver.

Optionally, at least one of the one or more conductors forms a part of the first pole element of the antenna.

Optionally, the attachment member comprises an additional conductor which forms at least a part of the first pole element of the antenna.

Optionally, the hearing aid also includes one or more additional attachment members, wherein the attachment member and the one or more additional attachment members have different respective sizes, and are configured for selective coupling to the hearing aid housing, wherein a length of the first pole element of the antenna is fixed regardless of which of the attachment member and the one or more additional attachment members is coupled to the hearing aid housing.

Optionally, the first pole element of the antenna extends over a length of the attachment member.

Optionally, the hearing aid also includes a variable matching circuit for electrically matching the antenna with the wireless communication unit.

Optionally, the antenna comprises a balanced dipole antenna.

Optionally, the first pole element of the antenna has a first section extending in the attachment member, and a second section extending in the hearing aid housing.

Optionally, the second section of the first pole element extending in the hearing aid housing has a same shape as the second pole element of the antenna.

Optionally, the second section of the first pole element extends along a first side of the hearing aid housing, and the second pole element of the antenna extends along a second side of the hearing aid housing.

A set of attachment members, includes: a first attachment member configured to couple with a hearing aid housing, the first attachment member having a first length; and a second attachment member configured to couple with the hearing aid housing, the second attachment member having a second length; wherein the first attachment member comprises a first antenna element having a first antenna length, and the second attachment member comprises a second antenna element having a second antenna length; and wherein an absolute relative difference between the first antenna length and the second antenna length is less than a threshold.

Optionally, the threshold comprises 10%.

Other and further aspects and features will be evident from reading the following detailed description of the embodiments.

It is envisaged that features and characteristics of one aspect and/or embodiment are applicable to another aspect and/or embodiment, mutatis mutandis.

The embodiments will now be described more fully hereinafter with reference to the accompanying drawings, in which exemplary embodiments are shown. The claimed invention may, however, be embodied in different forms and should not be construed as limited to the embodiments set forth herein. Like reference numerals refer to like elements throughout. Like elements will, thus, not be described in detail with respect to the description of each figure.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

DETAILED DESCRIPTION

Figure 1:
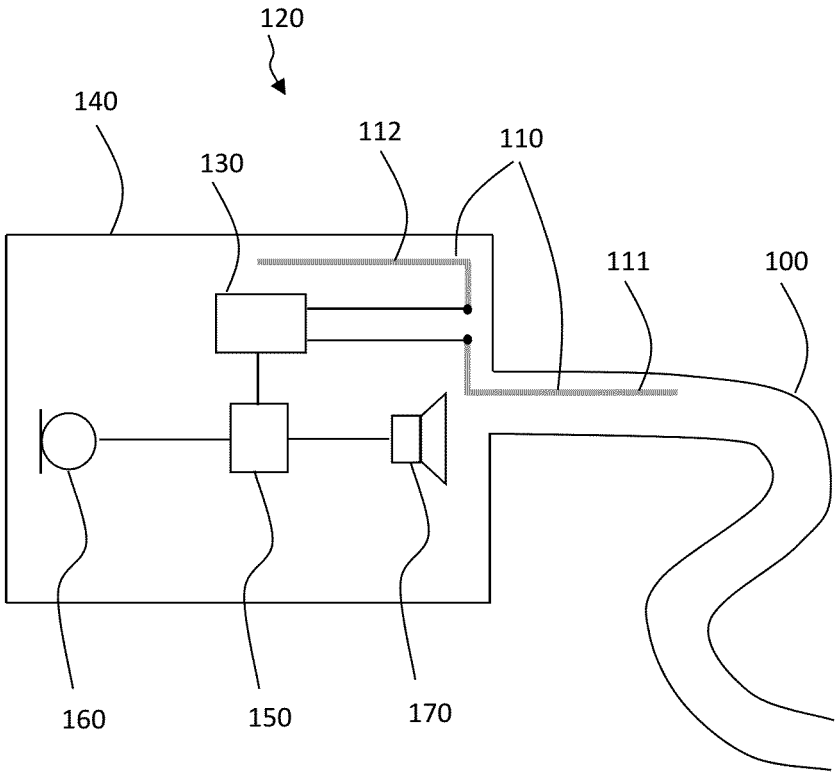
FIG. 1 shows schematically a behind the ear type hearing aid housing with a sound tube and having an antenna extending via the sound tube.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 shows schematically a behind the ear type hearing aid 120 having a hearing aid housing 140. The hearing aid housing comprises a microphone 160 for reception of sound and conversion of the received sound into a corresponding first audio signal, a signal processor 150 for processing the first audio signal into a second audio signal compensating a hearing loss of a user of the hearing aid 120, and a wireless communications unit 130 connected to the signal processor 150 for wireless data communication. The hearing aid has an attachment member 100 connectable to the hearing aid housing 140, and the wireless communications unit 130 is interconnected with an antenna 110 having a first pole element 111 and a second pole element 112 for emission and reception of an electromagnetic field. At least a part of the first pole element 111 extends via the attachment member 100, and the second pole element 112 extends in the hearing aid housing 140. The signal processor 150 is connected to a speaker 170 for conversion of the second audio signal into a sound. The attachment member 100 is a sound tube, and the sound is acoustically transmitted to the ear of a user (not shown) via acoustic wave propagation in the thin tube 100.

It is seen that the antenna 110 having first and second poles 111, 112 may be longer than an antenna 110 extending only in the hearing aid housing. In that the hearing aid designers strive to minimize the size of the hearing aids, it is an advantage that a part of the antenna may extend outside of the housing.

It is a further advantage that the antenna 110 is not connected to a ground plane in the hearing aid housing. Hereby, the radiation pattern of the antenna 110 is independent of e.g. circuit board radiation, and thereby the radiation pattern may be more tightly controlled. It is a further advantage that the first pole element 111 and the second pole element 112 are separated so that coupling between the first pole element 111 and the second pole element 112 is minimized.

Figure 2A:
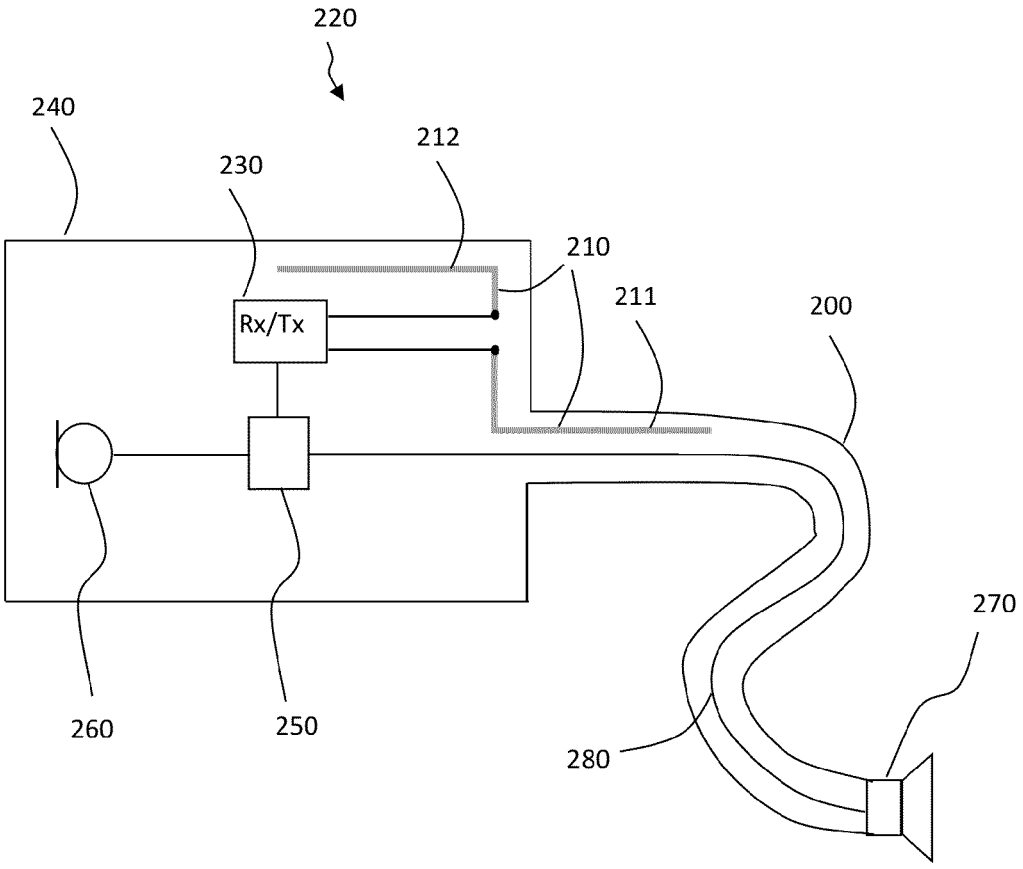
FIGS. 2*a* and 2*b* show a receiver in the ear type hearing aid having a hearing aid housing with an attachment member comprising one or more conductors and having an antenna extending via the attachment member.

FIG. 2*a* shows schematically a receiver in the ear type hearing aid 220 having a hearing aid housing 240. The hearing aid housing 240 comprises a microphone 260 for reception of sound and conversion of the received sound into a corresponding first audio signal, a signal processor 250 for processing the first audio signal into a second audio signal compensating a hearing loss of a user of the hearing aid 220, and a wireless communications unit 230 connected to the signal processor 250 for wireless data communication. The hearing aid has an attachment member 200 connectable to the hearing aid housing 240, and the wireless communications unit 230 is interconnected with an antenna 210 having a first pole element 211 and a second pole element 212 for emission and reception of an electromagnetic field. At least a part of the first pole element 211 extends via the attachment member 200, and the second pole element 212 extends in the hearing aid housing 240. The antenna 210 having a first pole element 211 and a second pole element 212 is fed approximately in the center from the wireless communications unit thus implementing a dipole antenna.

Conducting element 280 connects the signal processor 250 to receiver in the ear 270, thereby electrically transmitting the second audio signal from the signal processor 250 in the hearing aid housing 240 to the receiver in the ear 270. It is seen that the attachment member 200 is a cable assembly comprising at least conducting element 280 and at least a part of the first pole element 211. It is envisaged that more conducting elements may be provided connecting the receiver in the ear with hearing aid electronics, such as with the signal processor 250.

Figure 2B:
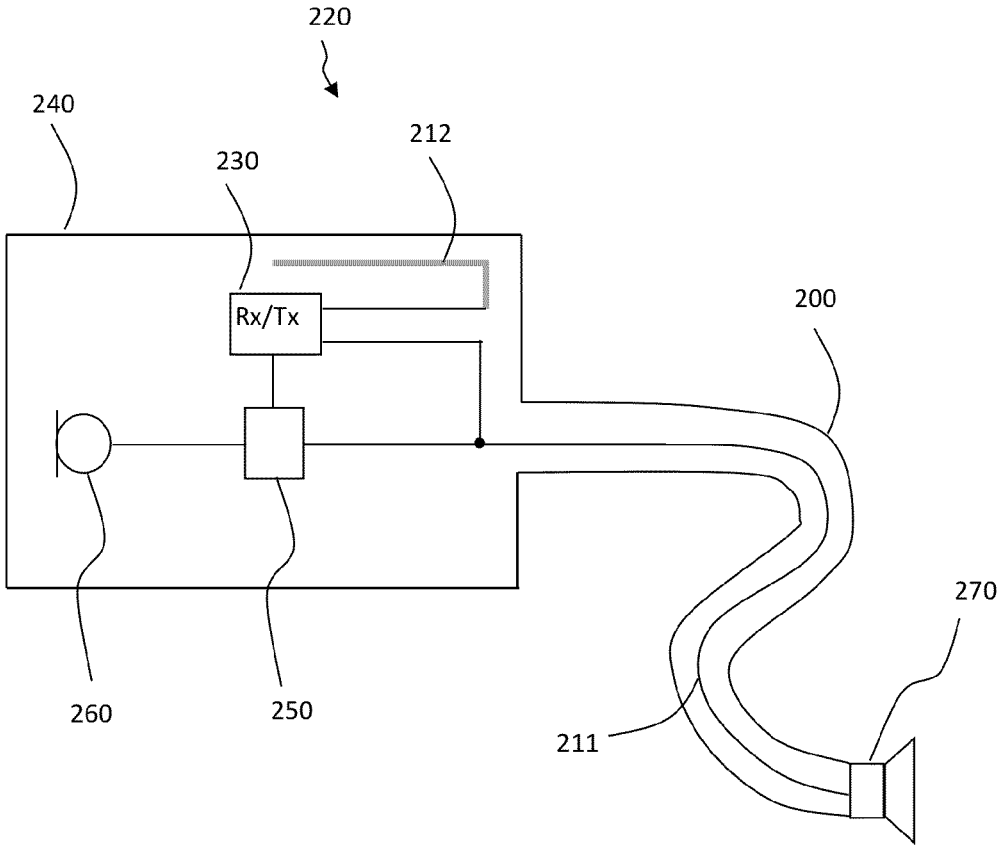

FIG. 2*b* shows schematically a hearing aid of the receiver in the ear type, wherein the conducting element 280 is also used as at least a part of the first pole element 211. The wireless communications unit 230 is connected to conducting element 280 and the conducting element 280 will act as the first pole element 211 of the antenna 210 for the wireless communications unit. In FIG. 2*b* it is seen that the first pole element extends over the entire length of the attachment member.

Figure 3:
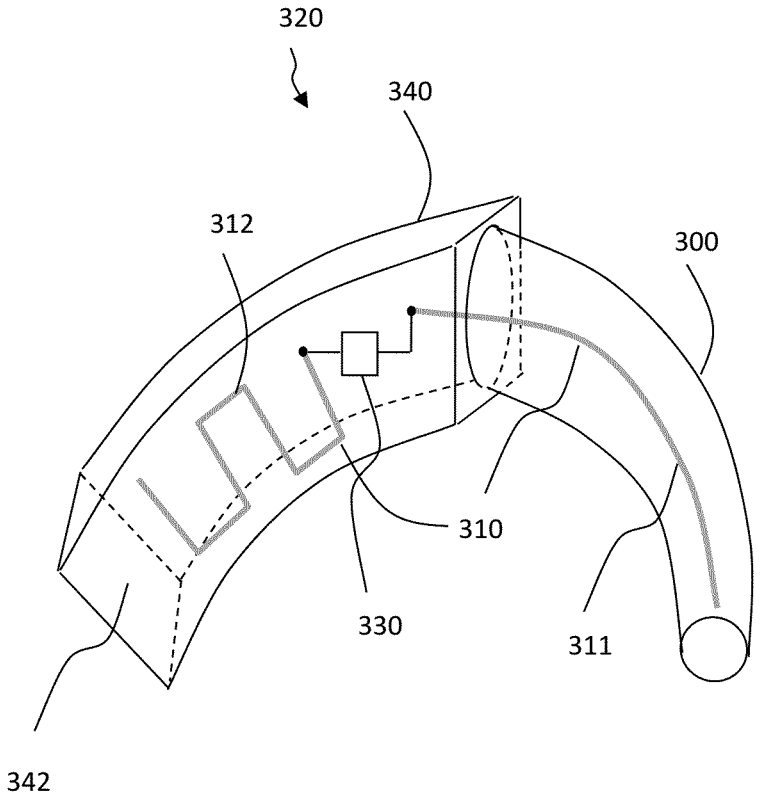
FIG. 3 shows a hearing aid housing with an attachment member wherein a first pole extends via the attachment member and a second pole extend along a side of the hearing aid housing.

FIG. 3 shows schematically a hearing aid housing with an attachment member in 3D. The hearing aid 320 may be any hearing aid type including a behind the ear hearing aid, a receiver in the ear type, etc. The attachment member 300 may thus be any attachment member including a sound tube, a cable assembly comprising at least one conducting element, a hook, etc. The wireless communications unit 330 and the antenna 310 interconnected with the wireless communications unit 330 is shown schematically, for clarification further elements, including signal processor etc., are not shown. The first pole element 311 extends via the attachment member 300 and the second pole element 312 extends along a side 342 of the hearing aid housing 340. In this embodiment, the hearing aid is preferably positioned so that the side 342 of the hearing aid housing 340 along which the second pole element 312 is positioned is fronting the surroundings and not the side of the head of a user when the hearing aid is worn in its intended operational position. Hereby, the field distribution of transmitted and/or received signals is most powerful in free air and any damping effect of the head of the user is reduced.

Figure 4:
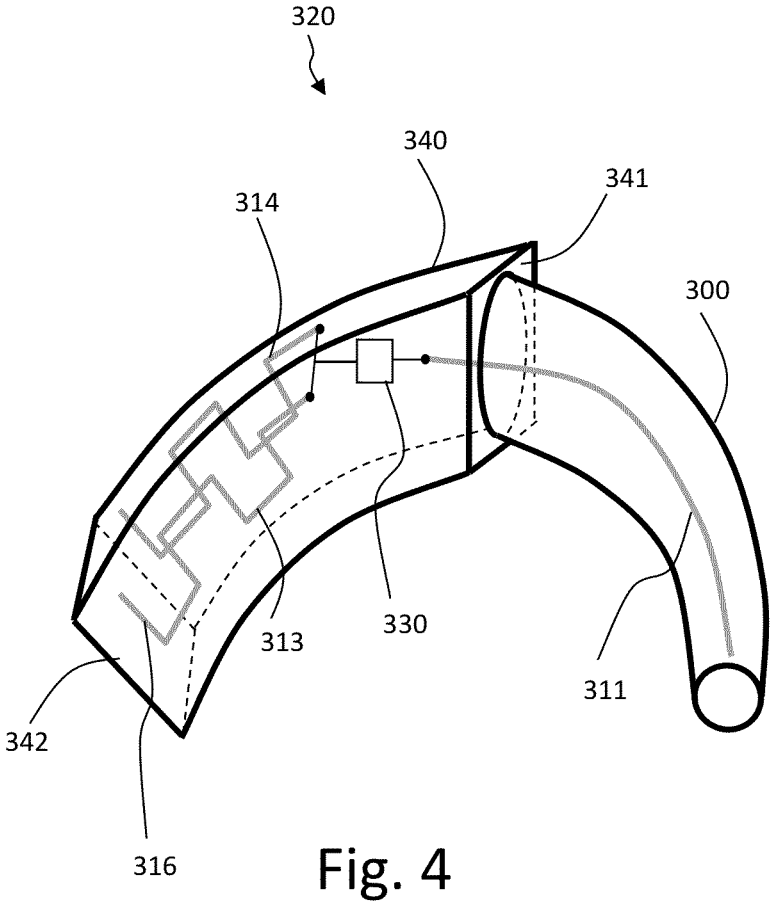
FIG. 4 shows a hearing aid housing with an attachment member wherein an antenna has a first pole extending via the attachment member and a second pole having a first and a second section, extending along a first and a second side of the hearing aid housing, respectively.

In FIG. 4, a hearing aid 320 as in FIG. 3 is shown. The hearing aid housing 340 has an attachment member 300 wherein an antenna 310 has a first pole element 311 extending via the attachment member 300 and a second pole element 314, 316 extending in the hearing aid housing 340. The second pole element 314, 316 has a first section 314 extending along a first side 341 of the hearing aid housing 340 and a second section 316 extending along a second side 342 of the hearing aid housing 340. In the present example the first section 314 and the second section 316 are of the same shape, they are identical. This is an advantage as the hearing aid may then be optionally positioned at the right ear or the left ear of a user and still obtain a same or at least comparable field distribution of a field received or transmitted by the antenna 310 comprising first pole element 311, first section 314 of second pole element 314, 316 and second section 316 of the second pole element 314, 316. It can be seen that the first section 314 and second section 316 are distributed symmetrically about a longitudinal center axis of the hearing aid housing 340. It is an advantage of having a symmetric antenna in the hearing aid housing 340 in that the field distribution about the antenna is the same or substantially the same regardless of whether the hearing aid is positioned on a right hand side of the user or a left hand side of the user.

Figure 5:
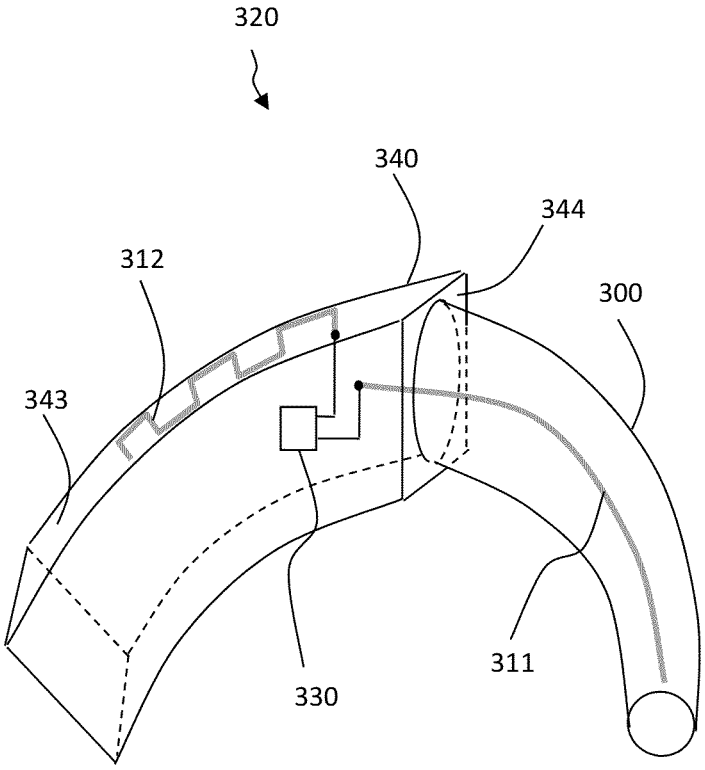
FIG. 5 shows a hearing aid housing with an attachment member wherein an antenna has a first pole extending via the attachment member and a second pole extend along a top side of the hearing aid housing.

FIG. 5 shows a hearing aid 320 with a hearing aid housing 340 with an attachment member 300 wherein an antenna 311, 312 has a first pole element 311 extending via the attachment member 300 and a second pole element 312 extending along a top side 343 of the hearing aid housing 340. Hereby, the field distribution of a transmitted and/or received signal may be substantially the same on both a right hand side and a left hand side of the hearing aid housing 340 in that the second pole element 312 of the antenna will experience a same, such as substantially a same, damping effect from the head of a user whether the hearing aid is provided on a left hand side or a right hand side of the hearing aid housing 340 in its intended operational position.

Figure 6:
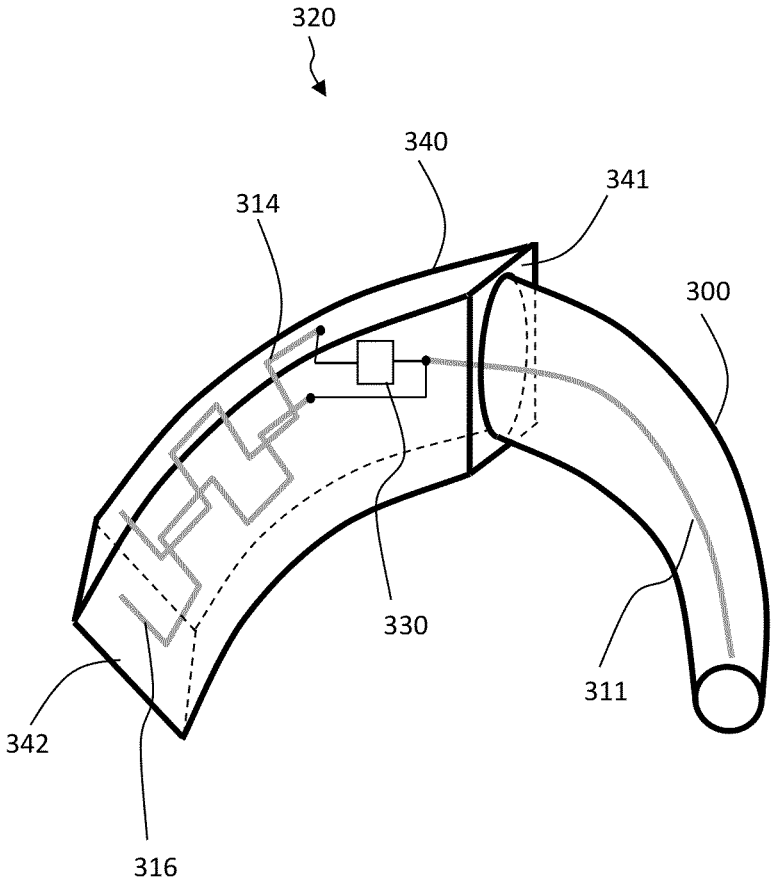
FIG. 6 shows a hearing aid housing with an attachment member wherein an antenna has a first pole having a first section extending via the attachment member and a second section extending along a side of the hearing aid and a second pole extending along another side of the hearing aid housing.

FIG. 6 shows a hearing aid housing 340 with an attachment member 300 wherein an antenna has a first pole element having a first section 311 extending via the attachment member 300 and a second section 313 extending along a side 342 of the hearing aid housing 340, and a second pole 314 extending along another side 341 of the hearing aid housing 340. In one or more embodiments, the length and/or shape of the second pole element 314 corresponds to the length and/or shape of the second section 313 of the first pole element to obtain a symmetric antenna in the hearing aid housing 340 as discussed above.

Figure 7:
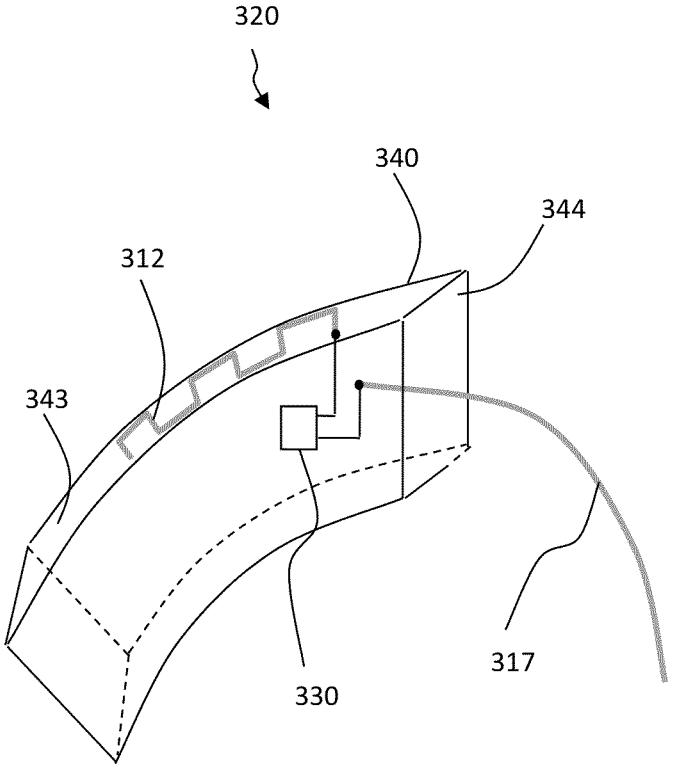
FIG. 7 shows a hearing aid housing without an attachment member wherein an antenna has a first pole extending outside of the hearing aid, and a second pole extending within the hearing aid housing.

In FIG. 7, a further embodiment is shown, wherein a hearing aid 320 has wireless communications unit 330 and an antenna interconnected therewith. The antenna has a first pole element 317 extending outside of the hearing aid housing, and a second pole element 312 extending within the hearing aid housing 340. Regarding the electromagnetic properties of the antenna, it may be advantageous to provide the first pole element 317 in free space.

Figure 8:
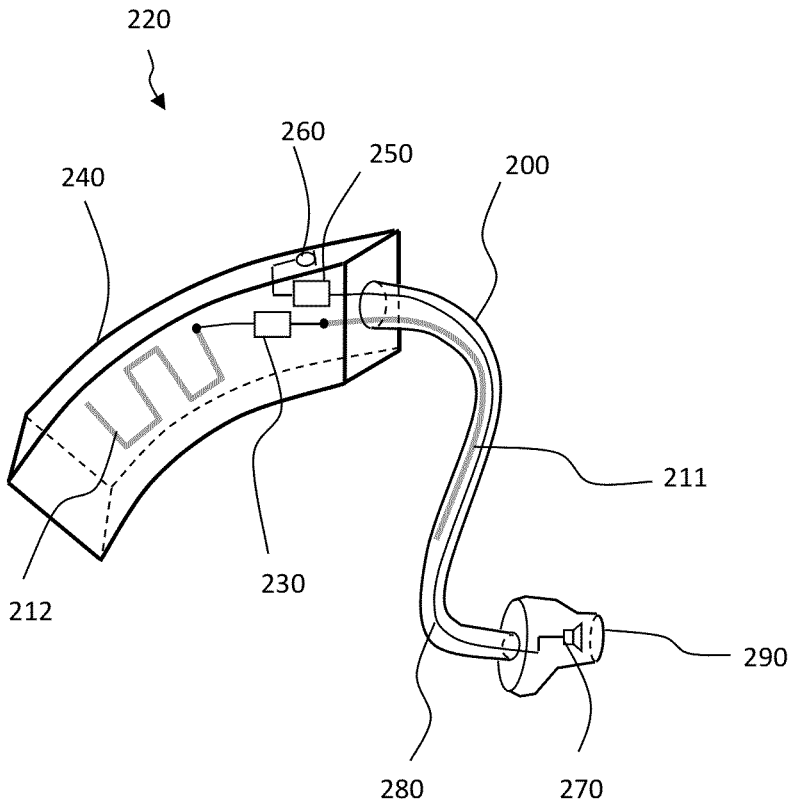
FIG. 8 shows a 3D drawing of a hearing aid housing with an attachment member and a receiver in the ear.

FIG. 8 shows schematically in 3D, a receiver in the ear type hearing aid 220 in more detail. The hearing aid 220 has a hearing aid housing 240 comprising a microphone 260, a signal processor 250, a wireless communications unit 230. An attachment member 200 comprises electrical conductor 280 transmitting the second audio signal from the signal processor 250 to the receiver in the ear 270. The receiver in the ear 270 is provided in an ear mould 290 configured to be positioned in the ear of a user. The wireless communications unit 230 is interconnected with an antenna having a first pole element 211 extending along the attachment member 200. The first pole element extends within the attachment member and an insulating material may be provided between the first pole element 211 and the electrical conductor 280, e.g. to avoid cross talk. A second pole element 212 extends within the hearing aid housing 240.

Figure 9:
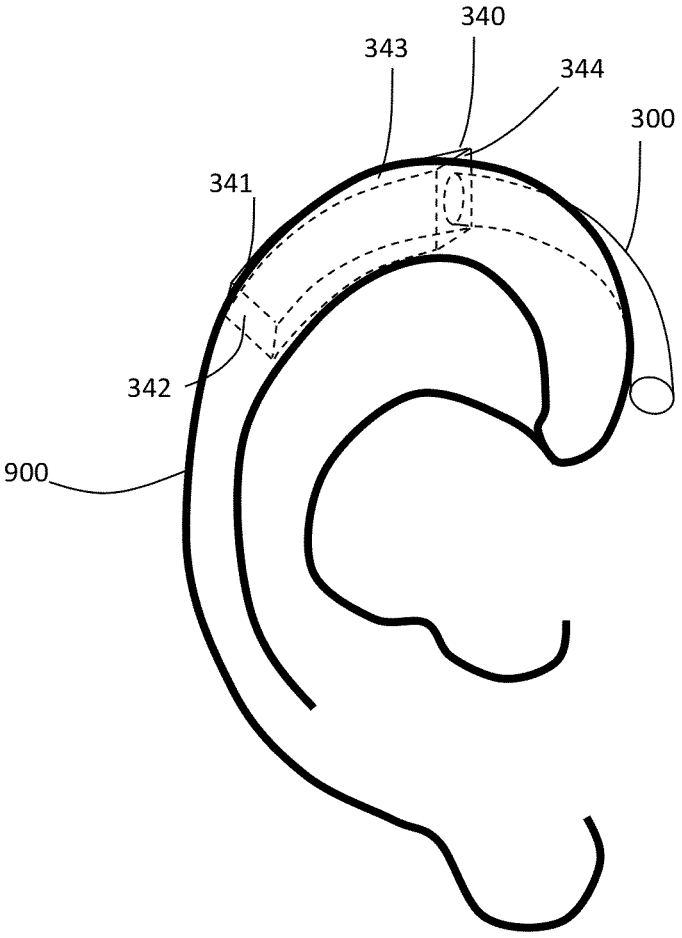
FIG. 9 shows the intended operational position of the hearing aid.
Figure 10:
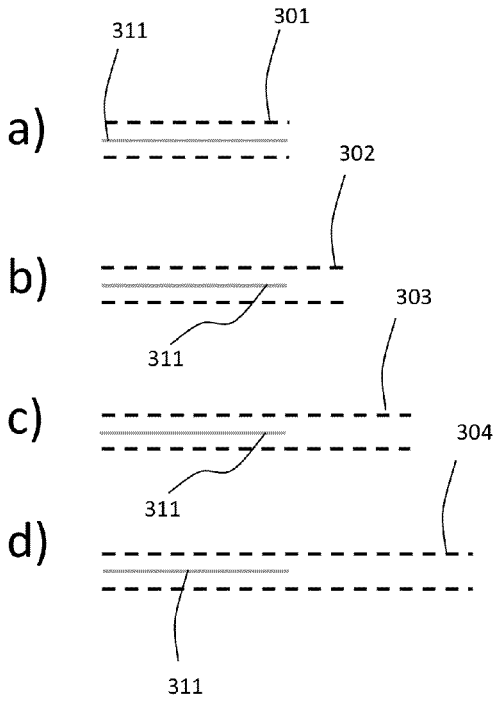
FIGS. 10*a-d* show fixed lengths of antenna extending in attachment members of different lengths.
Figure 11:
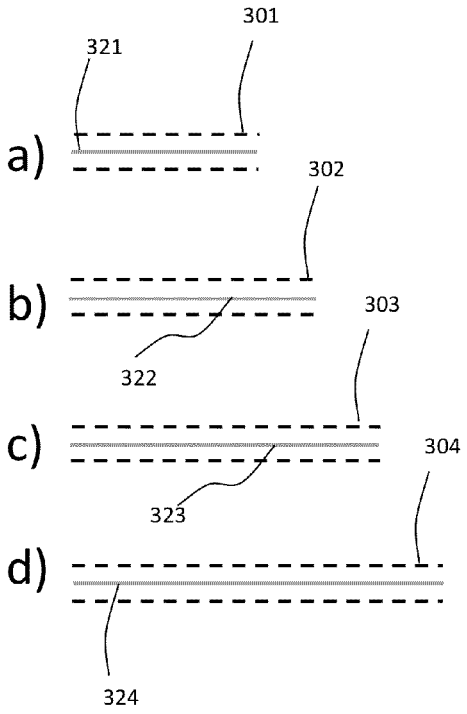
FIGS. 11*a-d* show variable lengths of antennas extending in attachment members of different lengths.

FIG. 9 shows the intended operational position of the hearing aid 320 behind the ear 900 of a user. The attachment member 300 is conveniently located at a face 344 of the hearing aid housing 320. The top side of the hearing aid is the side of the hearing aid housing 320 furthers away from the ear, the side 341 is the side of the hearing aid adjacent the head (not shown) of a user, and the side 342 is the side of the hearing aid exposed to the surroundings, i.e. exposed to the surroundings through the thin outer ear which is substantially loss less for the electromagnetic or RF radiation.

FIGS. 10*a-d* show fixed lengths of antennas 311 extending in attachment members 301, 302, 303, 304 of different lengths. The fixed lengths antennas may be monopole antennas, or the fixed length antennas may be dipole antennas wherein only one pole element of the dipole antenna is shown.

FIGS. 11*a-d* show variable lengths of antennas 321, 322, 323, 324 extending in attachment members 301, 302, 303, 304 of different lengths.

Table 1 below shows exemplary lengths of the attachment members for an attachment member being a sound tube.

| Tube name | length (mm) |
|---|---|
| −1B | 52.1 |
| 0A | 57.9 |
| 0B | 55.0 |
| 1A | 60.0 |
| 1B | 57.9 |
| 2A | 67.0 |
| 2B | 64.0 |
| 3A | 72.0 |
| 3B | 69.0 |

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

a hearing aid housing;

a microphone coupled to the hearing aid housing for reception of sound and conversion of the received sound into a corresponding first audio signal;

a signal processor in the hearing aid housing for processing the first audio signal into a second audio signal compensating a hearing loss of a user of the hearing aid;

a wireless communication unit connected to the signal processor for wireless data communication; and an attachment member connectable to the hearing aid housing, wherein the attachment member extends to an earpiece;

wherein the wireless communication unit is coupled with an antenna having a first pole element and a second pole element, the antenna configured for electromagnetic field emission and electromagnetic field reception; and wherein at least a part of the first pole element extends in the attachment member, and wherein the first pole element has a first end coupled to the wireless communication unit, a second end, and a first body extending between the first end and the second end; and wherein the second pole element has a third end coupled to the wireless communication unit, a fourth end, and a second body extending between the third end and the fourth end, wherein the fourth end is electrically decoupled from the signal processor, and wherein the second body of the second pole element extends in the hearing aid housing.

2. The hearing aid according to claim 1, wherein the attachment member is configured to transmit the second audio signal from within the hearing aid housing to an ear of the user.

3. The hearing aid according to claim 1, wherein the attachment member is configured to hold the hearing aid in its position around an ear of the user.

4. The hearing aid according to claim 1, wherein the antenna is confined within the hearing aid housing and the attachment member.

5. The hearing aid according to claim 1, wherein the attachment member comprises a conducting element, wherein the conducting element forms at least a part of the first pole element of the antenna.

6. The hearing aid according to claim 1, wherein the first pole element and the second pole element of the antenna have a same length.

7. The hearing aid according to claim 1, wherein the second pole element of the antenna comprises a patch antenna, a rod antenna, a meander line antenna, or any combination thereof.

8. The hearing aid according to claim 1, wherein the second pole element of the antenna extends along a top surface of the hearing aid housing.

9. The hearing aid according to claim 1, wherein the second pole element of the antenna has a first section extending along a first side of the hearing aid housing, and a second section extending along a second side of the hearing aid housing.

10. The hearing aid according to claim 9, wherein the first section and the second section are substantially symmetrical.

11. The hearing aid according to claim 9, wherein a length of the first section corresponds substantially to a length of the second section.

12. The hearing aid according to claim 1, wherein the attachment member comprises a sound tube.

13. The hearing aid according to claim 12, further comprising a converter for converting the second audio signal into an acoustic signal, wherein the sound tube is configured to transmit the acoustic signal to an ear of the user.

14. The hearing aid according to claim 1, further comprising a receiver sized for placement in an ear of the user, wherein the attachment member comprises one or more conductors conducting the second audio signal to the receiver.

15. The hearing aid according to claim 14, wherein at least one of the one or more conductors forms a part of the first pole element of the antenna.

16. The hearing aid according to claim 14, wherein the attachment member comprises an additional conductor which forms at least a part of the first pole element of the antenna.

17. The hearing aid according to claim 1, further comprising one or more additional attachment members, wherein the attachment member and the one or more additional attachment members have different respective sizes, and are configured for selective coupling to the hearing aid housing;

wherein a length of the first pole element of the antenna is fixed regardless of which of the attachment member and the one or more additional attachment members is coupled to the hearing aid housing.

18. The hearing aid according to claim 1, wherein the first pole element of the antenna extends over a length of the attachment member.

19. The hearing aid according to claim 1, further comprising a variable matching circuit for electrically matching the antenna with the wireless communication unit.

20. The hearing aid according to claim 1, wherein the antenna comprises a balanced dipole antenna.

21. The hearing aid according to claim 1, wherein the first pole element of the antenna has a first section extending in the attachment member, and a second section extending in the hearing aid housing.

22. The hearing aid according to claim 21, wherein the second section of the first pole element extending in the hearing aid housing has a same shape as the second pole element of the antenna.

23. The hearing aid according to claim 21, wherein the second section of the first pole element extends along a first side of the hearing aid housing, and the second pole element of the antenna extends along a second side of the hearing aid housing.

24. A set of attachment members, comprising:

a first attachment member configured to couple with a hearing aid housing, the first attachment member having a first length; and a second attachment member configured to couple with the hearing aid housing, the second attachment member having a second length;

wherein the first attachment member comprises a first antenna element having a first antenna length, and the second attachment member comprises a second antenna element having a second antenna length, the first attachment member having an attachment member end for coupling to an earpiece; and wherein the first antenna element comprises a first pole element that forms a part of a multiple-pole antenna when the first attachment member is coupled with the hearing aid housing, the multiple-pole antenna having a second pole element located in the housing;

wherein the first pole element has a first end for coupling to a wireless communication unit, a second end, and a first body extending between the first end and the second end; and wherein the second pole element has a third end for coupling to the wireless communication unit, a fourth end, and a second body extending between the third end and the fourth end, wherein the fourth end is electrically decoupled from a signal processor in the hearing aid housing.

25. The set of attachment members of claim 24, wherein an absolute relative difference between the first antenna length and the second antenna length is less than a threshold.

26. The set of attachment members of claim 25, wherein the threshold comprises 10%.

* * * * *